United States Patent [19]

DeKraker

[11] Patent Number: 5,007,678

[45] Date of Patent: Apr. 16, 1991

[54] CHAIR BACK HEIGHT ADJUSTMENT MECHANISM

[75] Inventor: Larry DeKraker, Holland, Mich.

[73] Assignee: Steelcase Inc., Grand Rapids, Mich.

[21] Appl. No.: 419,097

[22] Filed: Oct. 11, 1989

[51] Int. Cl.[5] ..... A47C 1/00

[52] U.S. Cl. ..... 297/353; 297/401

[58] Field of Search ..... 297/353, 410

[56] References Cited

U.S. PATENT DOCUMENTS

| | | | |
|---|---|---|---|
| 3,592,508 | 7/1971 | Druseikis | 297/410 X |
| 4,012,158 | 3/1977 | Harper | 297/353 X |
| 4,139,235 | 2/1979 | Elbert | 297/353 X |
| 4,451,084 | 5/1984 | Seeley | 297/353 |
| 4,616,877 | 10/1986 | Slaats et al. | 297/353 |
| 4,660,885 | 4/1987 | Suhr et al. | 297/353 |
| 4,662,681 | 5/1987 | Favaretto | 297/353 X |
| 4,662,682 | 5/1987 | Maurel | 297/353 |

*Primary Examiner*—Peter A. Aschenbrenner

*Attorney, Agent, or Firm*—Price, Heneveld, Cooper, DeWitt & Litton

[57] ABSTRACT

A chair back height adjustment mechanism includes an inner, generally rectangular bracket defining a pair of laterally spaced sockets adapted to receive a pair of chair back supports. An inner shell defines a plurality of guides which receive glides or tabs formed on the bracket. The bracket defines a rack portion facing the inner shell. A release handle is pivotally mounted on the inner shell. The handle defines teeth engageable with the rack portion of the bracket.

19 Claims, 6 Drawing Sheets

CHAIR BACK HEIGHT ADJUSTMENT MECHANISM

BACKGROUND OF THE INVENTION

The present invention relates to office furniture and more particularly to chairs including a vertically adjustable back assembly.

Different forms of chairs are available which are principally adapted to the office environment or which are task oriented. Such chairs generally include adjustable components to adapt them to the particular user and task. For example, the chairs may include vertical height adjustments for the seat, a swivel and tilt chair control and vertically adjustable backs. An example of a chair including vertically adjustable back assemblies may be found in commonly owned U.S. Pat. No. 4,043,592 entitled Adjustable Seat Back Mechanism and issued on Aug. 23, 1977. The chair disclosed in such patent includes a single vertical seat back support to which a seat back is slidably mounted. A seat back mechanism includes a channel shaped support plate secured to the back of the chair, a housing and a latching arrangement carried by the housing to permit stepwise vertical adjustment of the housing and support plate relative to the vertical support post of the chair. Examples of other chairs including back height adjustment mechanisms may be found in U.S. Pat. No. 3,526,430 entitled Back Height Adjustment Mechanism and issued on Sept. 1, 1970 to Eldon and U.S. Pat. No. 4,616,877 entitled Chair With Back Height Adjustment and issued on Oct. 14, 1986 to Slaats et al.

Many of the prior back adjustment assemblies have suffered from undue complexity, difficulty in assembly, unsightly appearance and difficulties in operation. Generally, the prior back height adjustment mechanisms require that the user operate them with both hands.

A need exist for a relatively simple, easily manufactured adjustment mechanism which is aesthetically pleasing and which provides increased ease of assembly, reliability and ease of use.

SUMMARY OF THE INVENTION

In accordance with the present invention, the aforementioned needs are substantially fulfilled. Essentially, the chair back height adjustment mechanism in accordance with the present invention includes an inner bracket adapted to be fixed to a generally vertically extending chair back support member. A chair back includes an inner shell having a surface facing the bracket. Slide means on the inner shell and the bracket are provided for slidably mounting the shell for vertical adjustment relative to the bracket. An outer shell is secured to the inner shell and encloses the bracket. An adjustment means or release lever mounted on the inner shell selectively engages the bracket for stepwise vertical adjustment of the inner and outer shells with respect to the bracket.

The chair back height adjustment mechanism is relatively easily manufactured employing conventional molding techniques. The principal portions of the height adjuster are enclosed within the chair back assembly resulting in an aesthetically pleasing appearance. One-handed operation of the height adjustment mechanism is achieved.

DETAILED DESCRIPTION OF THE PREFERRED EMBODIMENT

Figure 1:
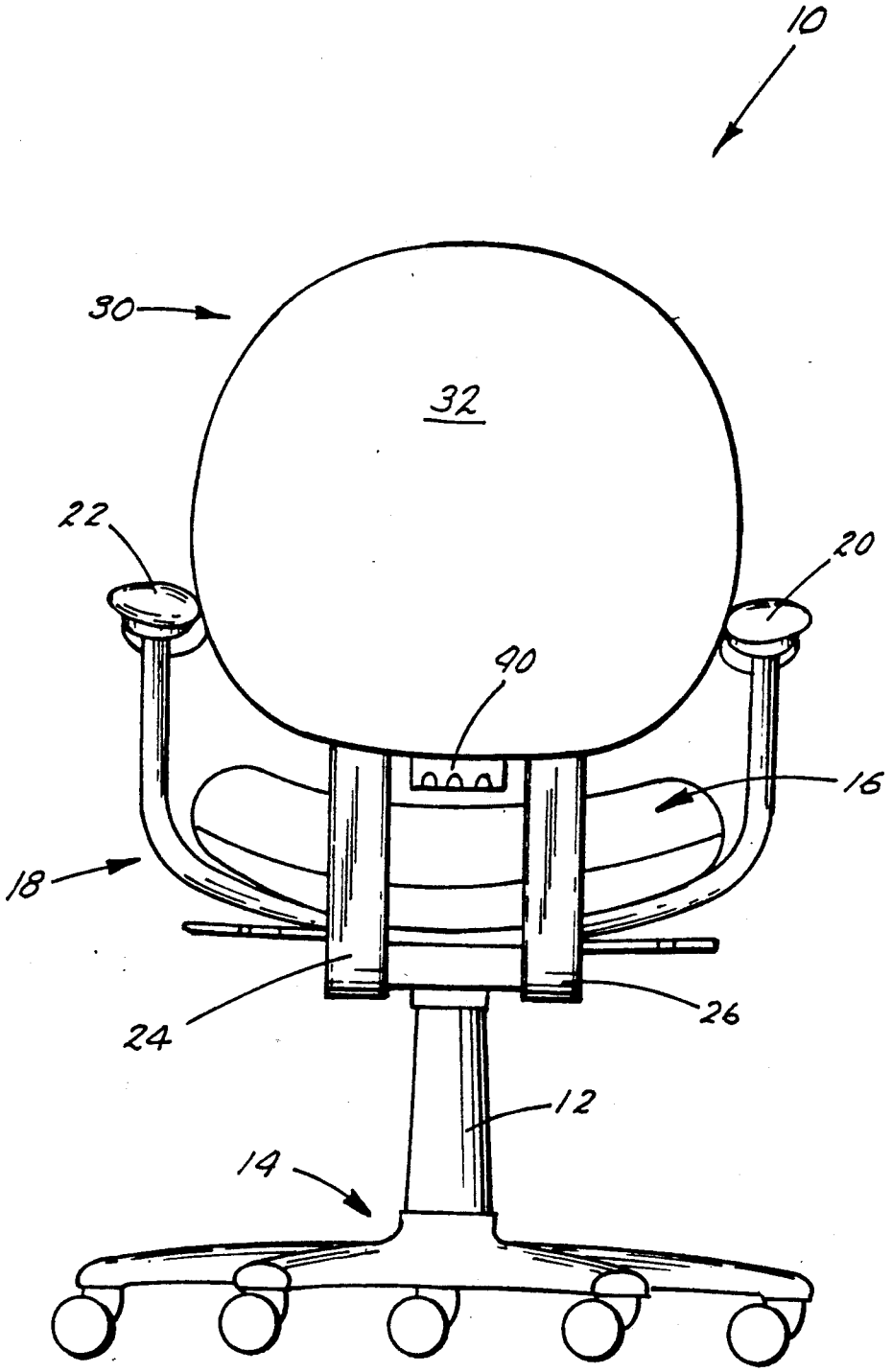
FIG. 1 is a rear, elevational view of a chair incorporating the back height adjustment mechanism in accordance with the invention.
Figure 2:
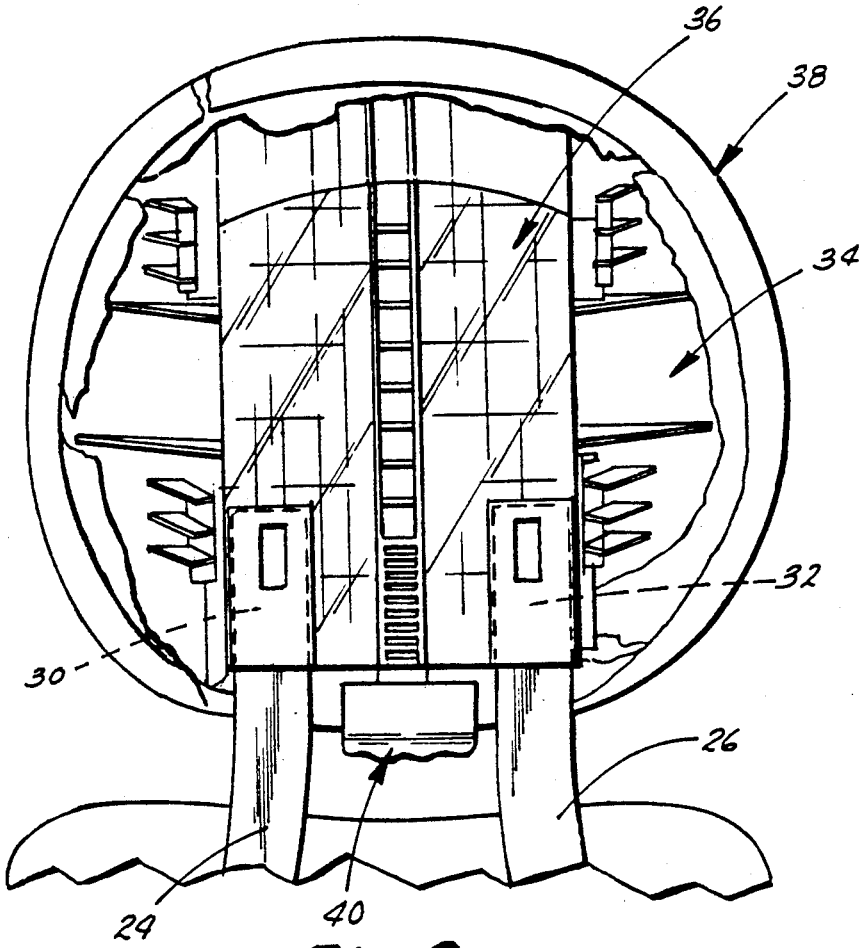
FIG. 2 is fragmentary, rear elevational view showing the inner shell, bracket and vertical supports.

A chair incorporating a back height adjustment mechanism in accordance with the present invention is illustrated in FIG. 1 and generally designated by the numeral 10. Chair 10 includes a support pedestal 12 mounted on a castered base 14. Mounted on pedestal 12 is a seat 16. Seat 16 may be secured to pedestal 12 by a swivel tilt or other chair control mechanism (not shown). Chair 10 further includes an armrest support 18 having armrest 20, 22 mounted thereon. Secured to pedestal 12 are a pair of laterally spaced, fixed, tubular chair supports 24, 26. As explained in more detail below, supports 24, 26 support or mount a vertically adjustable chair back assembly 30. Chair back assembly 30 includes an outer plastic shell 32, an inner shell 34, and an inner bracket or shell mount member 36. Inner shell 34 is covered by suitable foam and fabric materials 38. As seen in FIG. 2, bracket 36 is fixed to uprights 24, 26 at their upper ends 30, 32, respectively. Supported on inner shell 34 is a release lever or handle 40.

Inner bracket 36 is best seen in FIGS. 6–11. As shown therein, bracket 36 is a generally rectangular molded plastic item. It is presently preferred that the bracket be made from polypropylene. Bracket 36 includes an inner face 50, a top edge 52, a bottom portion 54 and spaced, lateral sides 56, 58. A central portion of bracket 36 is formed with a plurality of oppositely directed ribbed sections or generally rectangular portions 60, 62. The configuration of the bracket provides the needed rigidity or strength. A rack portion 64 is positioned centrally of bracket 36 adjacent lower edge 54. Rack 64 includes a plurality of teeth 66. An integral stop 68 is positioned in spaced relationship from upper edge 52.

Figure 4:
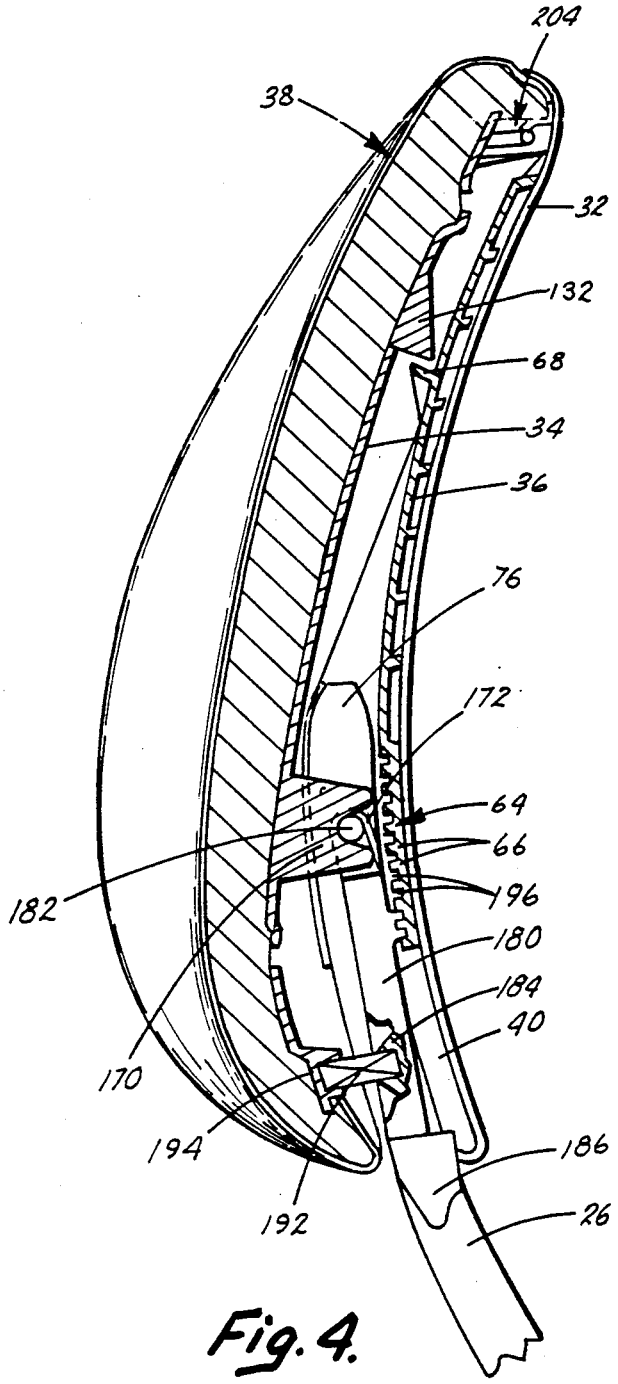
FIG. 4 is a cross sectional view taken generally along lines IV—IV FIG. 3.
Figure 10:
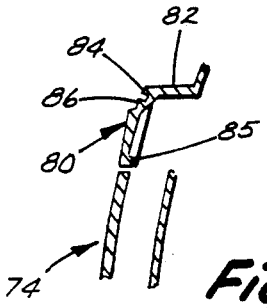
FIG. 10 is a cross sectional view taken generally along line X—X of FIG. 8.

Lower portion 54 of bracket 3 defines downwardly opening, spaced, parallel sockets 72, 74. The sockets are formed with a plurality of spaced, transversely extending ribs 76 on their outer surfaces. As seen in FIGS. 2, 4, and 10 sockets 72, 74 are dimensioned to receive back support uprights 24, 26.

Figure 4A:
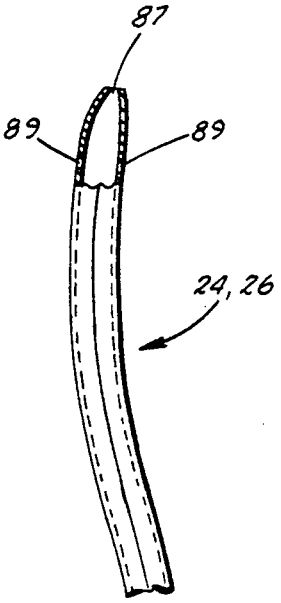
FIG. 4A is a fragmentary side elevational view of one of the chair back supports.
Figure 8:
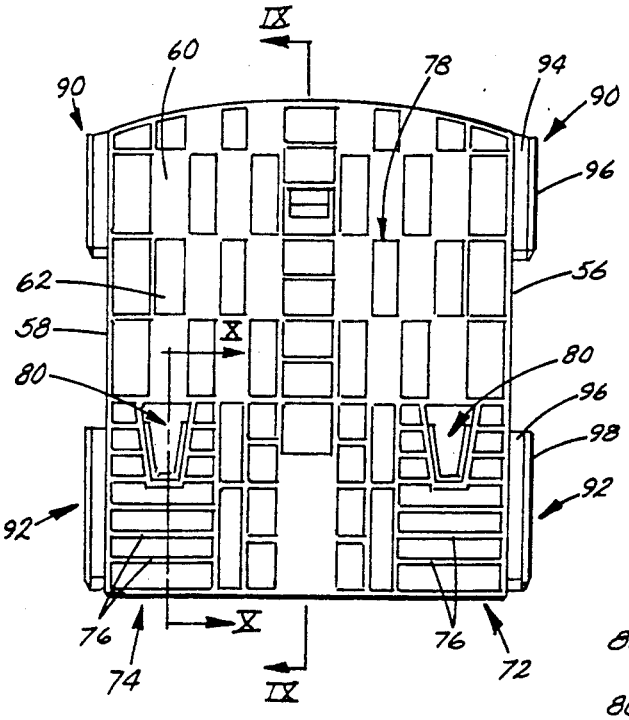
FIG. 8 is a rear, elevational view of the bracket.
Figure 9:
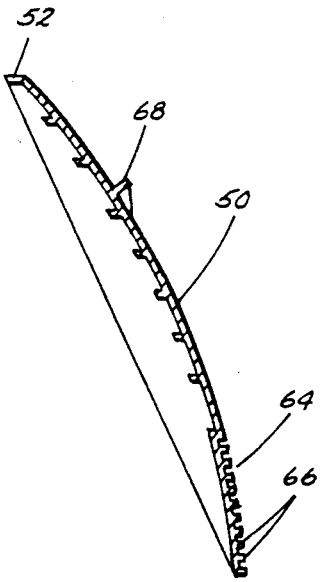
FIG. 9 is a cross sectional view taken generally along line IX—IX of FIG. 8.

An outer surface 78 of bracket 36 at sockets 72, 74 is formed with flexible locking tabs or detents 80. As shown in FIGS. 8 and 10, detents 80 are joined to an upper portion or wall 82 of each socket 72, 74 by a flexible hinge 84. Each tab includes an angled portion 85. As shown in FIG. 4A, each upright 24, 26 has an open end 87. Each upright also defines a pair of spaced lock apertures 89 opening in the front and back thereof.

When installing bracket 36 on uprights 24, 26, the bracket is pushed over the uprights and the detents or locking tabs 80 are bent inwardly and received in the opened ends of the uprights 24, 26. The upper open ends of the uprights are pushed against a ledge or locking shoulder 86 on the tab 80. Angled portion 85 is received within an aperture 89. As a result, inner bracket 36 will be firmly secured and locked to the uprights.

Figure 5:
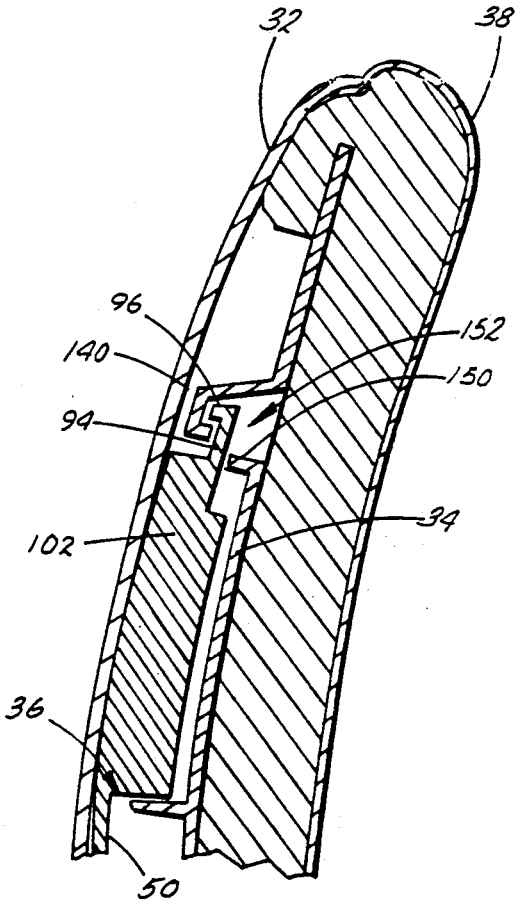
FIG. 5 is a cross sectional view taken generally along line V—V of FIG. 3.
Figure 6:
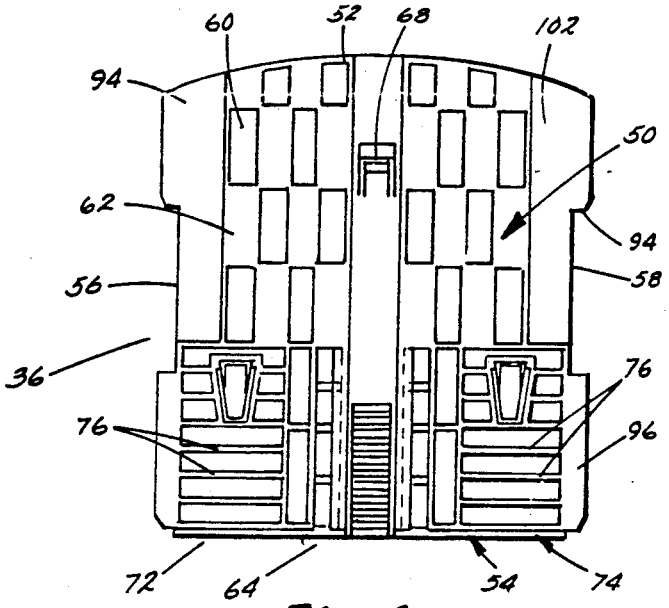
FIG. 6 is a front, elevational view of an inner bracket incorporated in the present invention.
Figure 7:
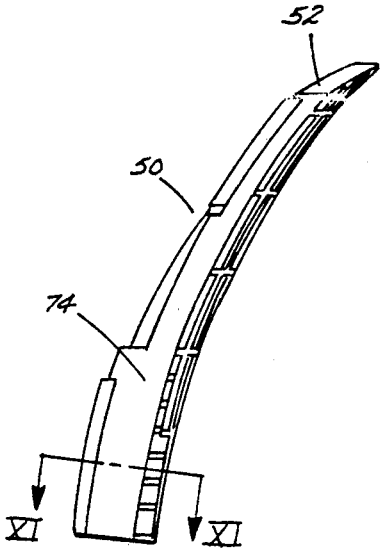
FIG. 7 is a right side elevational view of the bracket of FIG. 6.

Lateral sides 56, 58 of bracket 36 are formed or provided with vertically spaced glides or slides 90, 92. Each glide 90 includes a transversely extending flange or tab portion 94 and a perpendicular flange 96. Similarly each glide 92 includes a transversely extending flange 96 and a perpendicular flange 98. Tabs 94 are joined to an elongated block-like portion 102 an the inner face 50 of the bracket. This is best seen in FIGS. 5 and 6. As explained in more detail below, guides 90, 92 slidably receive or mount chair back shell 34.

Figure 11:
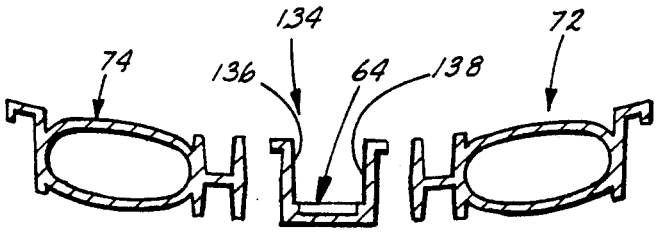
FIG. 11 is a cross sectional view taken generally along line X—X of FIG. 7.

Shell 34 (FIGS. 12 and 13) is molded from a suitable, plastic material such as polypropylene. The shell has an external configuration which corresponds to the shape of the seat back. One surface of shell 34 is covered or upholstered on surface 122 with suitable foam and fabric 38. An inner surface 124 of shell 34 defines suitable molded strengthening ribs and means permitting shell 34 to be slidably mounted on bracket 36. An open channel 126 extends along the vertical center line of shell 34. Channel 126 is defined by sidewalls 128, 130. A stop 132 is formed within channel 126 adjacent the upper edge of the shell. Channel walls 128, 130 are dimensioned to be received within a central channel 134 defined by bracket 36 (FIGS. 6 and 11). Central channel 134 includes sidewalls 136, 138. The cooperating channels provide stability to the chair back assembly.

Figure 12:
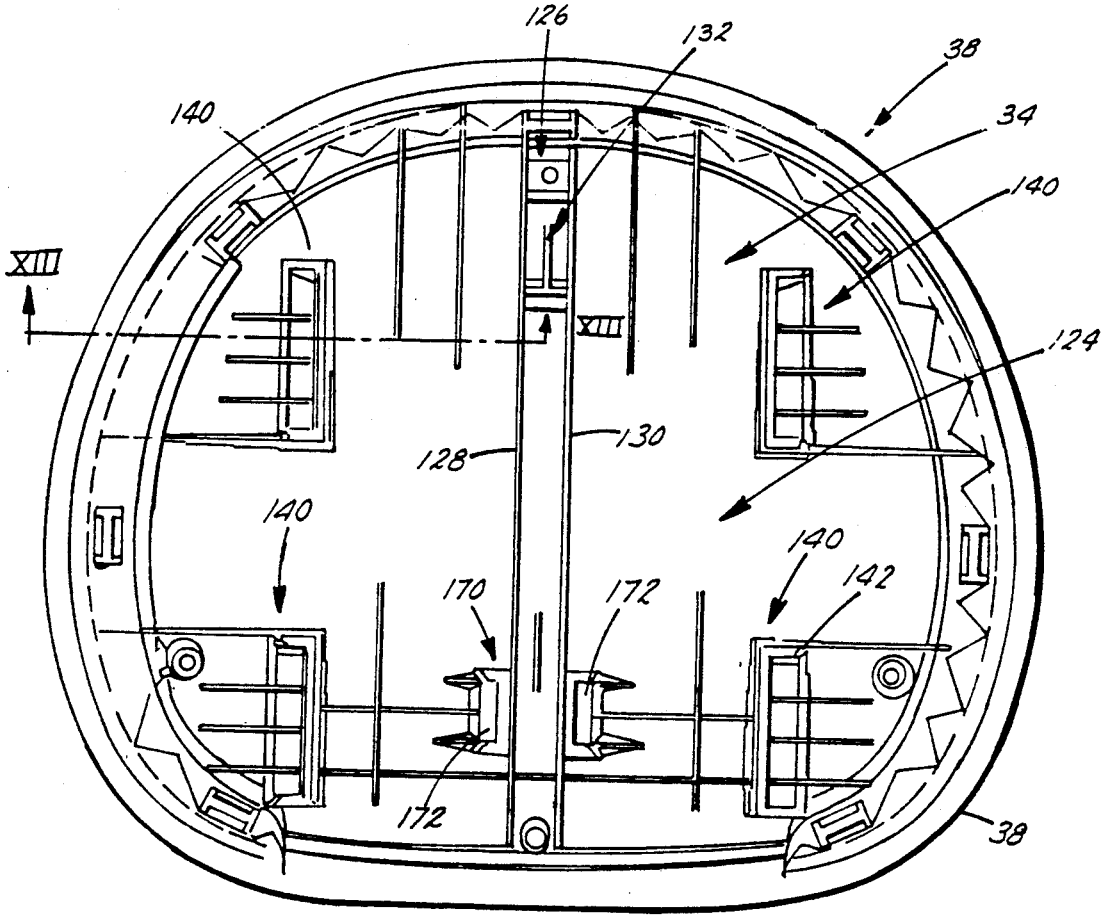
FIG. 12 is a rear, elevational view of the chair back inner shell and cushion.
Figure 13:
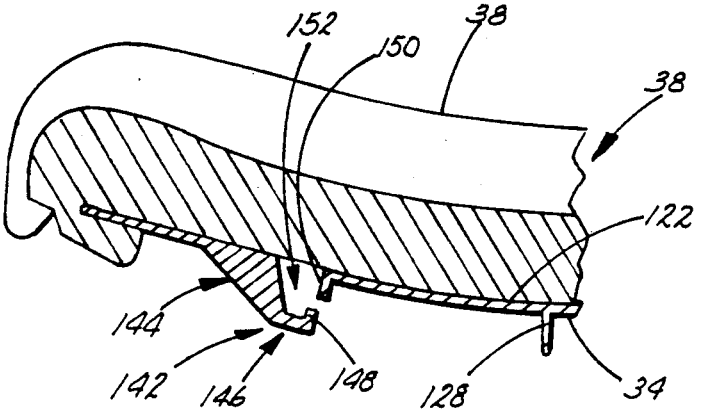
FIG. 13 cross sectional view taken generally along line XIII—XIII of FIG. 12.

As seen in FIGS. 12 and 13, shell 34 is formed with a plurality of identical guides 140 positioned symmetrically about the vertical center line. Guides 140 each include a ribbed generally L-shaped flange 142 having a generally vertically and outwardly extending portion 144 and a horizontally extending portion 146 which terminates in an inwardly directed edge 148. Guides 140, in cooperation with an outwardly directed flange 150 formed on the inner surface of shell 34, define a channel 152. As seen in FIG. 5, channel 152, which was opened at both ends, is dimensioned to receive the slide flanges or guides 90, 92 on the lateral edges of the inner bracket 36. Shell 34 is, therefore, mounted on bracket 36 for vertical adjustment or sliding movement.

As seen in FIGS. 4 and 12, rigid shell 34 further defines a release handle mount 170. Mount 170 defines spaced, generally U-shaped openings 172.

Figure 14:
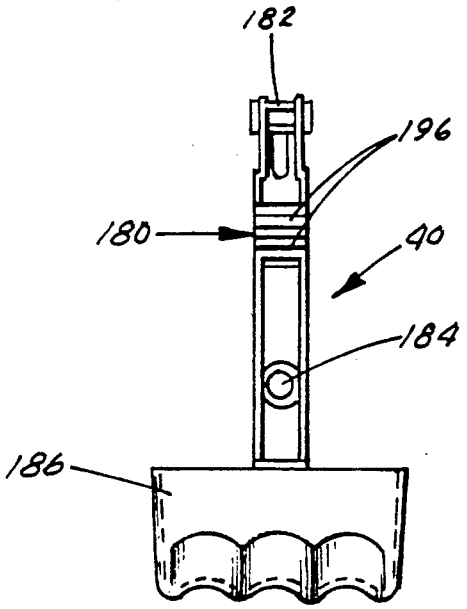
FIG. 14 is a front elevational view of a release handle incorporated in the present invention.
Figure 15:
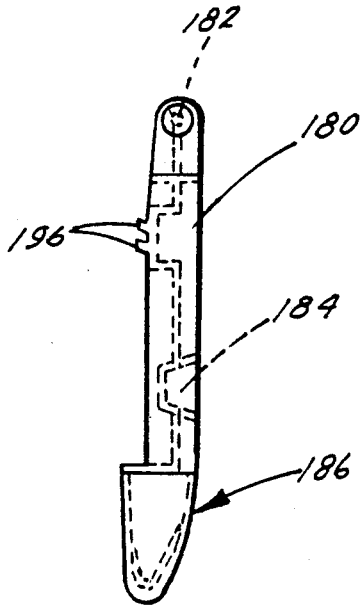
FIG. 15 is a side elevational view of the handle of FIG. 14.
Figure 3:
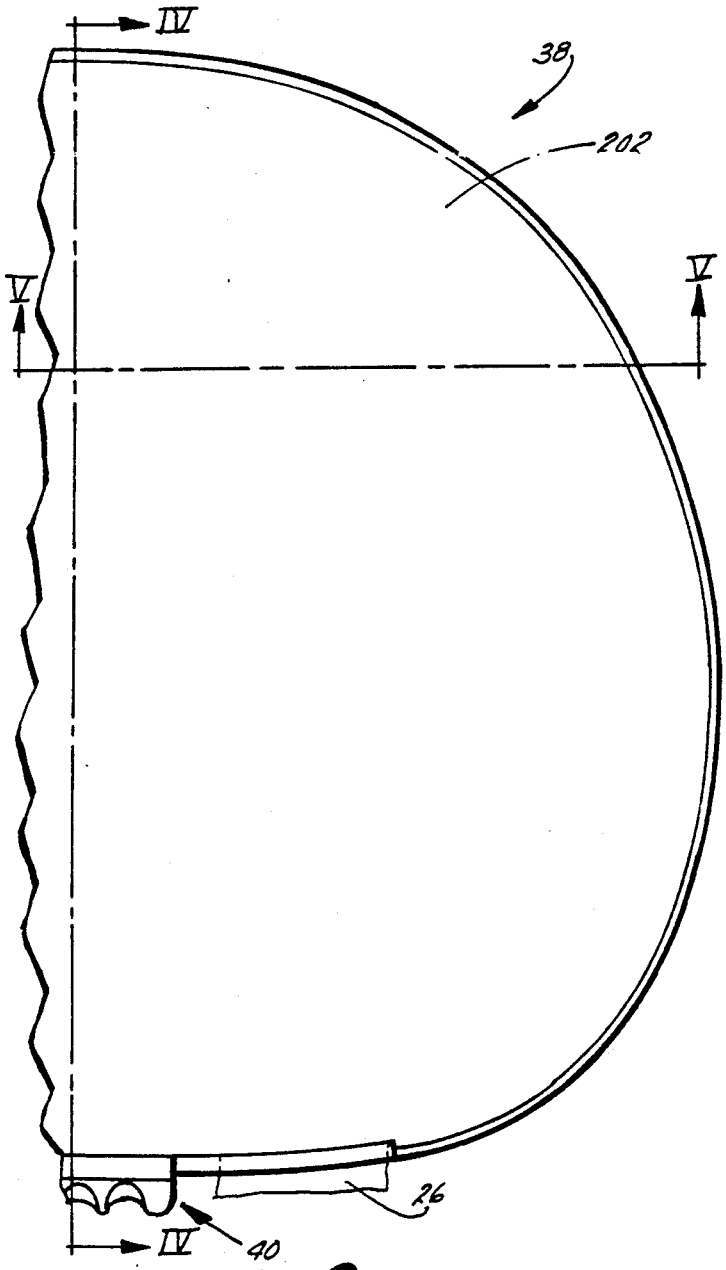
FIG. 3 is a rear, elevational view of the chair back assembly.

As seen in FIGS. 14 and 15, release handle or adjustment lever 40 includes an elongated portion 180 having an end terminating in pivot pins 182. A spring socket 184 is also defined by portion 180. Handle 40 is also molded with hand grip portion 186.

Assembly of the various components is illustrated in FIGS. 2, 4 and 5. As shown therein, bracket 36 is slipped onto and secured to the opened tubular uprights 24, 26. Handle 40 is positioned on rigid shell 34 with pivot pins 182 received in the pivot supports 170. A coil spring 192 is positioned between handle socket 184 and a spring socket 194 formed on shell 34. Shell 34 is then slipped onto bracket 36 with the slides or glides 90, 92 received within the respective channels 152 of the guides 140. Walls 128, 130 of channel 126 are disposed within guide channel 134 of bracket 34. Downward movement of shell 34 With respect to the uprights 24, 26 is limited by cooperating stops 68, 132. As shown in FIGS. 4, 14 and 15, handle 40 includes a pair of transversely extending teeth 196. Teeth 196 are dimensioned and positioned to receive one of the teeth 66 of rack portion 64.

The operating components of the back height adjustment mechanism are covered by chair outer shell 32. Shell 32 has a configuration which matches the outer peripheral configuration of inner shell 34 and cushion 38. Suitable fasteners 204 may be molded into shell 32 and in inner shell 34. As a result, the outer shell 32 may be readily snapped onto the assembly without the use of tools or separate fasteners. The cooperating shells fully enclose the slide bracket 36. The assembly provides an aesthetically pleasing appearance. The components are easily manufactured employing conventional molding techniques. Assembly is simplified when compared to prior back height adjustment mechanisms. One handed operation and stepwise vertical adjustment of the chair back is achieved.

In view of the foregoing description, the operation of the vertical back height adjustment mechanism in accordance with the present invention should be readily apparent. Once assembled, the operator need merely grasp handle portion 186 and pull it towards the front of shell 34 and hence the front of the chair against the bias of the spring 192. This action pulls teeth 196 out of engagement with rack teeth 66. The chair back assembly may be moved upwardly and downwardly with respect to bracket 36 and uprights 24, 26 by the hand which grasps the handle portion 186. Adjustment is possible from the seated position. Handle 40 is conveniently located between the uprights.

In view of the foregoing description those of ordinary skill in the art may envision various modifications which would not depart from the inventive concepts disclosed herein. The above description should, therefore, be considered as that of the preferred embodiment. The true spirit and scope of the present invention may be determined by reference to the appended claims.

The embodiments of the invention in which an exclusive property or privilege is claimed are as follows:

1. A chair back assembly, comprising:

an inner bracket having a socket adapted to receive a back support member, said inner bracket including a locking detent configured to engage the back support member and lock the inner bracket to said member;

an inner shell having a surface facing said bracket, said inner shell configured to define a chair back member;

slide means on said inner shell and said bracket for slideably mounting said inner shell for vertical adjustment relative to said bracket, said slide means including a slide and a cooperating guide, each on one of said inner shell and bracket;

adjustment means on said bracket and shell for releasably latching said shell to said bracket to permit thereby selective vertical positioning of said shell with respect to said bracket in a single handed fashion, and an outer shell secured to said inner shell, said outer shell dimensional and configured to enclose said inner bracket.

2. A chair back assembly as defined by claim 1 wherein said adjustment means comprises:

a rack on said bracket; and a release lever pivoted o said surface of said inner shell, said level defining a tooth dimensioned to engage said rack.

3. A chair back assembly as defined by claim 2 wherein said adjustment means further includes a spring engaging said release level for biasing said lever into engagement with said rack.

4. A chair back assembly as defined by claim 2 wherein said bracket has lateral sides, and wherein said slide means includes said lateral sides each defining a slide.

5. A chair back assembly as defined by claim 4 wherein said slide means includes said inner shell defining a pair of transversely spaced guides for receipt of said slides.

6. A chair back assembly as defined by claim 5 wherein each of said slides comprises:

a generally vertically extending slide surface and a slide flange extending generally perpendicular to said slide surface.

7. A chair back assembly as defined by claim 6 wherein each of said guides comprises:

a vertically extending flange positioned to engage said slide surface; and a generally L-shaped, vertically extending flange, said flange defining a channel for receipt of said slide flange.

8. A chair back assembly as defined by claim 7 wherein said adjustment means comprises:

a rack on said bracket; and a release level pivoted to said surface of said inner shell, said level defining a tooth dimensioned to engage said rack.

9. A chair back assembly as defined by claim 8 wherein said adjustment means further includes a spring engaging said release lever for biasing said level into engagement with said rack.

10. A back height adjustment mechanism for a chair of the type having a base, a seat on the base and a chair back upright extending vertically adjacent said seat, said mechanism comprising:

an inner bracket fixed to said upright, said bracket, defining a central channel having a pair of spaced sidewalls, said bracket further defining a pair of spaced glides on opposite lateral sides of said inner bracket, and wherein said inner bracket defines a downwardly opening socket dimensioned to receive said upright;

a chair back member defining an open channel having a pair of open channel sidewalls dimensioned to be received within said central channel of said inner bracket and a pair of guides which engage said glides, said guides being generally L-shaped in transverse cross section and define a channel for receipt of said glides, said back member thereby being mounted for vertical sliding movement on said inner bracket;

a release lever pivoted to said chair back member said release lever including a handle portion;

lock means on said release lever and said inner bracket for locking said chair back member in selected vertical positions with respect to said inner bracket; and an outer shell joined to said chair back member and enclosing said inner bracket, said lock means and an upper portion of said chair back upright.

11. A back height adjustment mechanism as defined by claim 10 wherein said lock means includes said inner bracket defining an elongated rack having a plurality of teeth.

12. A back height adjustment mechanism as defined by claim 11 wherein said lock means further comprises a tooth on said release lever and engageable with sa'd rack.

13. A back height adjustment mechanism as defined by claim 12 further including a spring engaging said release lever and biasing said lever into engagement with said rack.

14. A back height adjustment mechanism as defined by claim 10 wherein said inner bracket defines another pair of spaced glides and said chair back member defines another pair of guides engaging said another pair of spaced glides.

15. A back height adjustment mechanism as defined by claim 14 wherein said inner bracket defines a detent engaging said upright, said upright including an open upper end and defining a lock aperture for receipt of said detent.

16. A back height adjustment mechanism as defined by claim 15 wherein said adjustment means comprises:

a rack on said bracket; and a release lever pivoted to said inner shell, said lever defining a tooth dimensioned to engage said rack.

17. A back height adjustment mechanism as defined by claim 16 wherein said lock means comprises said inner bracket defining an elongated rack.

18. A back height adjustment mechanism as defined by claim 17 wherein said lock means further includes at least one tooth on said release lever moveable into engagement with said rack.

19. A back height adjustment mechanism as defined by claim 18 further including a spring biasing said lever towards said rack.

* * * * *

UNITED STATES PATENT AND TRADEMARK OFFICE

CERTIFICATE OF CORRECTION

PATENT NO. : 5,007,678

DATED : April 16, 1991

INVENTOR(S) : Larry DeKraker

It is certified that error appears in the above-identified patent and that said Letters Patent is hereby corrected as shown below:

Column 2, line 5;
After "the" insert --present--.
Column 2, line 11;
After "IV-IV" insert --of--.
Column 2, line 26;
"X-X" should be --XI-XI--
Column 2, line 29;
After "13" insert --is a--.
Column 3, line 3;
"bracket 3" should be --bracket 36--.
Column 5, line 17, claim 2;
"pivoted o" should be --pivoted to--.
Column 5, line 18, claim 2;
"level" should be --lever--.
Column 5, line 22, claim 3;
"level" should be --lever--.
Column 5, line 47, claim 8;
"level" should be --lever--.
Column 5, line 48, claim 8;
"level should be --lever--.
Column 5, line 52, claim 9;
"level" should be --lever--.

Signed and Sealed this

Twenty-third Day of February, 1993

*Attest:*

STEPHEN G. KUNIN

*Attesting Officer*

*Acting Commissioner of Patents and Trademarks*